United States Patent [19]

Draper, Jr. et al.

[11] 4,272,386

[45] Jun. 9, 1981

[54] ANTISTATIC, FABRIC-SOFTENING DETERGENT ADDITIVE

[75] Inventors: Ellsworth R. Draper, Jr.; Kenneth L. Jones, both of Cincinnati, Ohio

[73] Assignee: The Procter & Gamble Company, Cincinnati, Ohio

[21] Appl. No.: 71,424

[22] Filed: Aug. 30, 1979

Related U.S. Application Data

[63] Continuation-in-part of Ser. No. 961,445, Nov. 16, 1978, abandoned.

[51] Int. Cl.[3] ..... D06M 13/46; D06M 15/30; C11D 3/20; C11D 3/26

[52] U.S. Cl. ..... 252/8.6; 8/115.6; 8/137; 252/8.7; 252/8.75; 252/8.8; 252/8.9; 252/89.1; 252/113; 252/117; 252/120; 252/155; 252/527; 252/528; 252/548

[58] Field of Search ..... 252/8.6, 8.7, 8.75, 252/8.8, 8.9, 113, 117, 120, 130, 140, 155, 527, 528, 547, DIG. 2; 8/115.6, 137

[56] References Cited

U.S. PATENT DOCUMENTS

| | | | |
|---|---|---|---|
| 3,936,537 | 2/1976 | Baskerville et al. | 252/8.8 |
| 4,152,272 | 5/1979 | Young | 252/8.8 |

*Primary Examiner*—Joseph L. Schofer
*Assistant Examiner*—Herbert J. Lilling
*Attorney, Agent, or Firm*—Robert B. Aylor; Thomas H. O'Flaherty; Richard C. Witte

[57] ABSTRACT

Described are detergent-compatible antistatic compositions produced by the at least partial complexing of certain anionic complexing components and particles of an intimate mixture of quarternary ammonium compounds and organic dispersion inhibitor materials. The complex formed, which is relatively water-impenetrable and insoluble, constitutes at least 25% of the surfaces of the particulate detergent additive of this invention. These compositions provide static control benefits in laundering operations at reduced antistatic levels.

30 Claims, No Drawings

ANTISTATIC, FABRIC-SOFTENING DETERGENT ADDITIVE

CROSS REFERENCE TO RELATED APPLICATION

This application is a continuation-in-part of copending application Ser. No. 961,445 and now abandoned, Draper and Jones, for Antistatic Fabric Softening Detergent Additive, filed Nov. 16, 1978.

TECHNICAL FIELD

This invention relates to compositions which provide static control benefits in fabric laundering operations. More particularly, it relates to providing these benefits at reduced antistatic agent levels while simultaneously cleansing fabrics by means of conventional detergent compositions and detergency builders.

BACKGROUND ART

Various quaternary ammonium compounds are known in the art to possess antistatic properties. These quaternary ammonium componds are also known to be generally incompatible with anionic surfactants commonly employed in laundering compositions. The anionic surfactants attack and inactivate the quaternary ammonium compounds in the wash-water environment. Thus, larger amounts than desired of the fairly expensive quaternary ammonium compounds must be added to detergent compositions in order to avoid total inactivation in wash solution. It therefore would be highly beneficial, from a performance and economic standpoint, to be able to shield the quaternary ammonium compounds in the wash water, without disturbing their effectiveness as static control agents in the subsequent machine drying process.

Techniques known in the art for preserving the antistatic properties of the quaternary ammonium compounds, such as the prilling of the quarternary ammonium compound with organic dispersion inhibitors, as disclosed in U.S. Pat. No. 3,936,537, Baskerville et al, issued Feb. 3, 1976, incorporated herein by reference, and the agglomeration of that prill with certain water-soluble neutral or alkaline salts, using organic agglomerating agents, as disclosed in U.S. Pat. No. 4,141,841, McDonald, issued Feb. 27, 1979, incorporated herein by reference, while delivering improved static control and softening benefits over methods then known in the art, were only partially effective. Some of the quaternary ammonium compound continued to be inactivated by the anionic surfactants, and some of the prills continued to be broken up and dispersed in the wash water, preventing the efficient deposition of antistatic materials of an effective size range onto the fabrics to be treated. The above-described techniques still required the addition of larger quantities of the quaternary ammonium compound than necessary to achieve good static control in the absence of the detergent. Also, the conventional organic agglomerating agents, such as dextrin glue solutions, required in McDanald to agglomerate the prills with the salts could cause poor caking characteristics and flowability problems in the detergent product under certain conditions, making handling and packaging difficult at times.

The present invention, by contrast, teaches the deliberate pre-wash-water complexing of certain anionic components with the quaternary ammonium compounds to deliver superior static control at significantly reduced levels of antistatic material. The Baskerville et al and McDanald references attempted to avoid the interaction of anionic components with the quaternary ammonium compound upon which the present invention is based. Further, it has been discovered that water can act as the agglomerating agent and/or the complexing medium, while producing a product with at least equivalent caking characteristics, and even superior caking qualities under certain conditions. Thus, the organic agglomerating agents required in McDanald have been eliminated in the present invention, reducing material costs and eliminating extra processing and handling steps.

It is an object of the present invention to provide a particulate detergent additive composition which delivers static control and fabric-softening benefits to laundered fabrics while using a minimum amount of antistatic/softening agent.

It is also an object of the present invention to provide a detergent composition capable of concurrently laundering, softening, and imparting static control benefits to fabrics washed therewith and subsequently machine dried.

SUMMARY OF THE INVENTION

The present invention encompasses a particulate detergent additive for preventing static buildup on textiles and softening fabrics when applied thereto from a laundry solution, said particulate additive being produced by the at least partial complexing of:

(a) from about 1% to about 90% by weight of an anionic complexing component selected from the group consisting of anionic synthetic surfactants; soaps, nonsurfactant electrolytes selected from the group consisting of alkali metal phosphates, borates, carbonates, silicates, sulfates, and citrates; and mixtures thereof; and (b) from about 10% to about 99% by weight of particles of an intimate mixture of:

(i) from about 90% to about 20% by weight of a quaternary ammonium compound of formula $[R_1R_2R_3R_4N]^+Y^-$ wherein at least one, but not more than two, of $R_1$, $R_2$, $R_3$, and $R_4$ is an organic radical containing a group selected from a $C_{16}$–$C_{22}$ aliphatic radical, or an alkyl phenyl or alkyl benzyl radical having 10 to 16 carbon atoms in the alkyl chain, the remaining group or groups being selected from $C_1$–$C_4$ alkyl, $C_2$–$C_4$ hydroxy alkyl, and cyclic structures in which the nitrogen atom forms part of the ring, Y constituting an anionic radical selected from the group consisting of hydroxide, halide, sulfate, methylsulfate, ethylsulfate and phosphate ions, and (ii) from about 10% to about 80% by weight of a dispersion inhibitor, being a solid organic material having a solubility in water of 50 ppm maximum at 25° C. and a softening point in the range of 75° F. to 250° F., said material being selected from the group consisting of paraffinic waxes, cyclic and acyclic mono- and polyhydric alcohols, substituted and unsubstituted aliphatic carboxylic acids, esters of the foregoing alcohols and acids, $C_3$–$C_4$ alkylene oxide condensates of any of the foregoing materials and mixtures thereof, wherein said complex constitutes at least 25% of the surfaces of said particulate additive and wherein substantially all of the additive particles have a size of about 10 microns to about 500 microns, a solubility in water of about 50 ppm maximum at 25° C., and a softening point of from about 75° F. to about 250° F.

The present invention also encompasses a detergent composition, for preventing static buildup on textiles and softening fabrics laundered therewith, comprising:

(1) from about 5% to about 85% by weight of surfactant selected from the group consisting of anionic, nonionic, ampholytic, and zwitterionic surfactants, and mixtures thereof, (2) from about 5% to about 85% by weight of detergency builder material, (3) from about 3% to about 50% by weight of a particulate detergent additive produced by the at least partial complexing of:

(a) from about 1% to about 90% by weight of an anionic complexing component selected from the group consisting of anionic synthetic surfactants; soaps; nonsurfactant electrolytes selected from the group consisting of alkali metal phosphates, borates, carbonates, silicates, sulfates, and citrates; and mixtures thereof; and (b) from about 10% to about 99% by weight of particles of an intimate mixture of:

(i) from about 90% to about 20% by weight of a quaternary ammonium compound of formula $[R_1R_2R_3R_4N]^+Y^-$ wherein at least one, but not more than two, of $R_1$, $R_2$, $R_3$, and $R_4$ is an organic radical containing a group selected from a $C_{16}$–$C_{22}$ aliphatic radical, or an alkyl phenyl or alkyl benzyl radical having 10 to 16 carbon atoms in the alkyl chain, the remaining group or groups being selected from $C_1$–$C_4$ alkyl, $C_2$–$C_4$ hydroxyalkyl, and cyclic structures in which the nitrogen atom forms part of the ring, Y constituting an anionic radical selected from the group consisting of hydroxide, halide, sulfate methylsulfate, ethylsulfate and phosphate ions; and (ii) from about 10% to about 80% by weight of a dispersion inhibitor, being a solid organic material having a solubility in water of 50 ppm maximum at 25° C. and a softening point in the range of 75° F. to 250° F., said material being selected from the group consisting of paraffinic waxes, cyclic and acyclic mono- and polyhydric alcohols, substituted and unsubstituted aliphatic carboxylic acids, esters of the foregoing alcohols and acids, $C_3$–$C_4$ alkylene oxide condensates of any of the foregoing materials and mixtures thereof, wherein said complex constitutes at least 25% of the surfaces of said particulate additive and wherein substantially all of the additive particles have a size of about 10 microns to about 500 microns, a solubility in water of about 50 ppm maximum at 25° C., and a softening point of from about 75° F. to about 250° F.

DISCLOSURE OF THE INVENTION

This invention comprises the deliberate, pre-wash-water complexing of quaternary ammonium compounds with certain anionic complexing components to deliver superior static control at significantly reduced levels of antistatic material. The antistatic particles of the present invention are formed by the at least partial complexing of the cationic quaternary ammonium compound with the anionic complexing components. The complex formed should constitute at least 25% of the surfaces of the antistatic particles. More preferably, the complex constitutes at least 50% of the surfaces, and most preferably the complex constitutes substantially all the surfaces of the antistatic particles. The reaction can also result in the complexation of substantially all of the quaternary ammonium compound, although it is preferred that the complexing be limited to the surfaces of the antistatic particles. While not intending to be limited by theory, it is believed that the present antistatic particles deliver static control advantages because they are less susceptible to wash-water penetration and breakup than the uncomplexed quaternary ammonium particles, thereby allowing for a more efficient deposition of antistatic material of an effective size range and composition onto the laundered fabrics. The complexed material, which is relatively water-impenetrable and water-insoluble, separates unreacted quaternary ammonium antistatic material from the wash-water environment and thus hinders the inactivation of this antistatic material by anionic surfactants. Further, the complex itself may provide some additional static control of its own to the system. Thus, the anionic complexing component should be chosen, in view of the particular cationic antistatic agent used, to achieve such a water-impenetrable and insoluble complex. The complexing components should also be chosen to maximize the antistatic properties of the complex itself.

Particulate additives comprising the quaternary ammonium static control agents complexed with these anionic materials are described in concurrently filed U.S. patent application Ser. No. 064,955, Jones, filed Aug. 8, 1979, incorporated herein by reference.

As another preferred embodiment, a mixture of anionic complexing components is used. Especially preferred are mixtures of sodium tripolyphosphate (STP) with the other complexing components described herein. Such a mixture, with several possible participating complexing components, can assist in the formation of the desired complex. Further, anionic complexing components which are water-soluble neutral or alkaline salts, especially STP, can absorb excess moisture making the particulate detergent additive stronger and more free-flowing.

The additive products of the present invention can be admixed or agglomerated with smectite clays to enhance fabric softening, and the detergent composition of this invention can additionally contain water-soluble detergency compounds and detergency builder salts. The quaternary ammonium compound provides antistatic benefits on the fabrics and also adds an increment of softening benefit to the fabrics, while the detergent surfactant and builder components provide known cleansing and building benefits.

The individual particle size of the particulate detergent additive lies in the range from about 10 microns to 500 microns, preferably from about 25 microns to about 250 microns, and most preferably from about 50 microns to about 100 microns. Further, the particulate additive should not have a solubility in water at 25° C. of greater than 50 ppm (parts per million), preferably less than 10 ppm. The softening or melting point of the particulate additive should lie in the range from about 100° F. to about 250° F., preferably from about 100° F. to about 200° F., more preferably from about 150° F. to about 175° F. The above specified ranges need not apply to complexed quaternary ammonium compound particles free of the organic dispersion inhibitor material, although the ranges preferably also apply in this situation. Individual particles of the particulate detergent additive can become agglomerated during processing steps. These agglomerates have a size of from about 10 microns to about 2500 microns. The agglomerates break-up in the wash water, but the individual particles remain relatively water-impenetrable and insoluble.

Anionic Complexing Component

The anionic complexing component required to form the complex is selected from the group consisting of anionic synthetic surfactants; soaps; nonsurfactant electrolytes selected from the group consisting of alkali metal orthophosphates, polyphosphates, borates, tetraborates, silicates, sulfates, and citrates; and mixtures thereof. The anionic component represents from about 1% to about 90% by weight, more preferably from about 5% to about 60% by weight, of the particulate detergent additive. The anionic component is preferably reacted with the quaternary ammonium antistatic agent, or antistatic agent/dispersion inhibitor mixture, as a solution (preferably a water solution) which comprises from about 1% to about 80% by weight, preferably from about 5% to about 50% by weight of the anionic component. Preferably, the anionic complexing component is present in such a solution at a concentration close to its saturation point. The anionic complexing solution is preferably sprayed onto the quaternary ammonium compound itself, or onto prills, agglomerates or admixes containing it. A fluidized bed reactor can also be used to contact the anionic solution with the quaternary compound particles or prills. The anionic complexing component can optionally be admixed as a solid with the quaternary ammonium compound before being complexed, preferably by being sprayed with a complexing medium, such as water or an aqueous complexing solution.

Nonsurfactant electrolytes suitable as the anionic complexing component include alkali metal phosphates, borates, carbonates, silicates, sulfates, citrates, and mixtures thereof. Preferred are sodium tetraborate, potassium tetraborate, sodium tripolyphosphate, potassium tripolyphosphate, sodium pyrophosphate, potassium pyrophosphate, sodium hexametaphosphate, potassium hexametaphosphate, sodium sulfate, potassium sulfate, sodium citrate, potassium citrate, and mixtures thereof. Especially preferred are sodium tripolyphosphate, sodium sulfate, and mixtures thereof.

Water-soluble salts of the higher fatty acids, i.e. "soaps", are useful as the anionic complexing component herein. Suitable are ordinary alkali metal soaps such as the sodium, potassium, ammonium, and alkanolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soaps.

Anionic synthetic surfactants useful as a complexing component herein include water-soluble salts, particularly the alkali metal, ammonium and alkanolammonium salts, of organic sulfuric reaction products having in their molecular structure an alkyl group containing from about 8 to about 22 carbon atoms and a sulfonic acid or sulfuric acid ester group. (Included in the term "alkyl" is the alkyl portion of acyl groups). Examples of this group of synthetic surfactants which can be used in the present invention are the sodium and potassium alkyl sulfates, especially those obtained by sulfating the higher alcohols ($C_8$–$C_{18}$ carbon atoms) produced by reducing the glycerides of tallow or coconut oil; sodium or potassium $C_8$–$C_{20}$ paraffin sulfonates; and sodium and potassium alkyl benzene sulfonates, in which the alkyl group contains from about 9 to about 15 carbon atoms in straight chain or branched chain configuration, e.g., those of the type described in U.S. Pat. Nos. 2,220,099 and 2,477,383, incorporated herein by reference.

Other anionic surfactant compounds useful herein include the sodium alkyl glyceryl ether sulfonates, especially those ethers of higher alchols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain from about 8 to about 13 carbon atoms.

Other useful anionic surfactants herein include the water-soluble salts of esters of alpha-sulfonated fatty acids containing from about 6 to 20 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkene sulfonates containing from about 10 to 20 carbon atoms in the alkane group; and beta-alkyloxy alkane sulfonates containing from about 1 to 3 carbon atoms in the alkyl group and from about 8 to 20 carbon atoms in the alkane moiety.

Other useful anionic surfactants utilizable herein are olefin sulfonates having about 12 to about 24 carbon atoms. The term "olefin sulfonates" is used herein to mean compounds which can be produced by the sulfonation of alpha-olefins by means of uncomplexed sulfur trioxide, followed by neutralization of the acid reaction mixture in conditions such that any sulfones which have been formed in the reaction are hydrolyzed to give the corresponding hydroxyalkane sulfonates. The sulfur trioxide can be liquid or gaseous, and is usually, but not necessarily; diluted by inert diluents for example by liquid $SO_2$, chlorinated hydrocarbons, etc., when used in the liquid form, or by air, nitrogen, gaseous $SO_2$, etc., when used in the gaseous form.

The alpha-olefins from which the olefin sulfonates are derived are mono-olefins having 12 to 24 carbon atoms, preferably 14 to 16 carbon atoms. Preferably they are straight chain olefins. Examples of suitable 1-olefins include 1-dodecene, 1-tetradecene, 1-hexadecene, 1-octadecene, 1-eicosene, and 1-tetracosene.

In addition to the true alkene sulfonates and a portion of hydroxyalkane sulfonates, the olefin sulfonates can contain minor amount of other materials, such as alkene disulfonates depending upon the reaction conditions, proportion of reactants, the nature of the starting olefins and impurities in the olefin stock and side reactions during the sulfonation process.

Preferred anionic synthetic surfactants are alkali and alkaline earth metal, ammonium and alkanol ammonium salts of linear and branched $C_{10}$–$C_{14}$ alkyl benzene sulfonates, $C_{10}$–$C_{20}$ alpha-sulfo carboxylic acid salts and esters in which the alkyl group has 1–8 carbon atoms, $C_{10}$–$C_{20}$ alkane sulfonates, $C_{14}$–$C_{18}$ olefin sulfonates, $C_{10}$–$C_{18}$ alkyl sulfates and mixtures thereof.

The preferred group of anionic complexing components for use herein includes sodium tetraborate, potassium tetraborate, sodium tripolyphosphate, potassium tripolyphosphate, sodium pyrophosphate, potassium pyrophosphate, sodium hexametaphosphate, potassium hexametaphosphate, sodium sulfate, potassium sulfate, sodium citrate, potassium citrate, $C_{10}$–$C_{14}$ linear and branched alkyl benzene sulfonates, $C_{10}$–$C_{18}$ alkyl sulfates, and mixtures thereof. Especially preferred anionic complexing components are sodium tripolyphosphate, sodium sulfate, $C_{10}$–$C_{14}$ linear and branched alkylbenzene sulfonates, and mixtures thereof.

Quaternary Ammonium Antistatic Agent

The cationic component of the present invention is a quaternary ammonium antistatic agent, which will be employed in the particulate detergent additive in an amount from about 10% to about 99% by weight, preferably from about 20% to about 75% by weight, more preferably from about 30% to about 60% by weight. Suitable quaternary ammonium antistatic agents are included in U.S. Pat. No. 3,936,537, Baskerville et al, which has been incorporated hereinabove by reference. In the preferred embodiment of the present invention where the quaternary ammonium compound is intimately mixed with an organic dispersion inhibitor and formed into a prill prior to the complexing reaction, the quaternary ammonium antistatic agent will normally be employed at a level of from about 90% to about 20% by weight, and more preferably from about 80% to about 50% by weight, of the intimate mixture.

The antistatic agents useful herein are quaternary ammonium salts of the formula $[R_1R_2R_3R_4N]^+Y^-$ wherein $R_1$ and preferably $R_2$ represent an organic radical containing a group selected from a $C_{16}$–$C_{22}$ aliphatic radical or an alkyl phenyl or alkyl benzyl radical having 10–16 atoms in the alkyl chain, $R_3$ and $R_4$ represent hydrocarbyl groups containing from 1 to about 4 carbon atoms, or $C_2$–$C_4$ hydroxy alkyl groups and cyclic structures in which the nitrogen atom forms part of the ring, and Y is an anion such as halide, methylsulfate, or ethylsulfate.

In the context of the above definition, the hydrophobic moiety (i.e., the $C_{16}$–$C_{22}$ aliphatic, $C_{10}$–$C_{16}$ alkyl phenyl or alkyl benzyl radical) in the organic radical $R_1$ may be directly attached to the quaternary nitrogen atom or may be indirectly attached thereto through an amide, ester, alkoxy, ether, or like grouping.

The quaternary ammonium antistatic agents used in this invention can be prepared in various ways well known in the art. Many such materials are commercially available. The quaternaries are often made from alkyl halide mixtures corresponding to the mixed alkyl chain lengths in fatty acids. For example, the "ditallow" quaternaries are made from alkyl halides having mixed $C_{14}$–$C_{18}$ chain lengths. Such mixed di-long chain quaternaries are useful herein and are preferred from a cost standpoint. As used herein "ditallow" is intended to refer to the above-described ditallowalkyl quaternaries.

The quaternary ammonium antistatic compounds useful herein include both water-soluble and substantially water-insoluble materials. Imidazolinium compounds enumerated in the Baskerville patent possess appreciable water solubility and can be utilized in the present invention by mixing with the appropriate type and level of organic dispersion inhibitor and complexing component to give ultimate particle solubility in water of less than 50 ppm (parts per million) at 25° C. Relatively water-soluble quaternary ammonium antistatic agents may also be of the nonring variety, such as diisostearyl dimethyl ammonium chlorides disclosed in U.S. Pat. No. 3,395,100 to Fisher et al, incorporated herein by reference. Exemplary quaternary ammonium imidazolinium compounds are specifically methyl-1-alkylamidoethyl-2-alkyl imidazolinium methyl sulfates, specifically 1-methyl-1-[(tallowamido)ethyl]-2-tallowimidazolinium methyl sulfate. However, the most useful quaternary ammonium antistatic agents are characterized by relatively limited solubility in water.

The following are representative examples of substantially water-insoluble quaternary ammonium antistatic agents suitable for use in the compositions of the instant invention. All of the quaternary ammonium compounds listed can be formulated with the detergent compositions herein, but the compilation of suitable quaternary compounds hereinafter is only by way of example and is not intended to be limiting of such compounds. Dioctadecyldimethyl ammonium chloride is an especially preferred quaternary antistatic agent for use herein by virtue of its high antistatic activity; ditallow dimethyl ammonium chloride is equally preferred because of its ready availability and its good antistatic activity; other useful di-long chain quaternary compounds are dicetyl dimethyl ammonium chloride; bis-docosyl dimethyl ammonium chloride; didodecyl dimethyl ammonium chloride; ditallow dimethyl ammonium bromide; dioleoyl dimethyl ammonium hydroxide; ditallow dimethyl ammonium chloride; ditallow dipropyl ammonium bromide; ditallow dibutyl ammonium fluoride; cetyldecylmethylethyl ammonium chloride; bis-[ditallow dimethyl ammonium] sulfate; tris-[ditallow dimethyl ammonium] phosphate; and the like.

The preceding description of quaternary ammonium antistatic compounds is an abbreviated discussion. Description in further detail in contained in the Baskerville et al patent.

Organic Dispersion Inhibitor

As a preferred embodiment of the present invention, the particulate detergent additive contains an organic dispersion inhibitor which is intimately mixed with the quaternary ammonium compound in the form of a prill prior to the complexing reaction. The organic dispersion inhibitor adds to the water-impenetrability and insolubility of the complex formed and thus enhances the antistatic benefits realized from the present invention. The organic dispersion inhibitor represents from about 10% to about 80% by weight, more preferably from about 20% to about 50% by weight, of the intimate mixture. The intimate mixture represents from about 10% to about 99%, preferably from about 20% to about 90%, most preferably from about 30% to about 70% by weight of the particulate detergent additive. The dispersion inhibitor should have a solubility in water of 50 ppm maximum at 25° C. and a softening point in the range of 100°–200° F., preferably 125°–200° F., and is preferably selected from the group consisting of paraffinic waxes, cyclic and acyclic mono- and polyhydric alcohols, substituted and unsubstituted aliphatic carboxylic acids, esters of the foregoing alcohols and acids, $C_3$–$C_4$ alkylene oxide condensates of any of the foregoing materials and mixtures thereof.

Tallow alcohol is preferred because of ready availability, but useful dispersion inhibitors include other fatty alcohols in the $C_{14}$–$C_{26}$ range, such as myristyl alcohol, cetyl alcohol, stearyl alcohol, arachidyl alcohol, behenyl alcohol, and mixtures thereof. Saturated fatty acids having 12 to 24 carbon atoms in the alkyl chain can be used, such as: lauric acid, myristic acid, palmitic acid, stearic acid, arachidic acid, and behenic acid, as well as mixtures of these, particularly those derived from naturally occurring sources such as tallow, coconut, and marine oils. Esters of the aliphatic alcohols and fatty acids are useful dispersion inhibitors, provided they have a total of more than 22 carbon atoms in the acid and alkyl radicals. Long chain $C_{22}$–$C_{30}$ paraffinic hydrocarbon materials such as the saturated hydrocarbon octacosane having 28 carbon atoms can also be used. When fatty acids are used as dispersion inhibitors as hereinabove described, the anionic complexing component may not include soaps, which are more fully described above.

Another preferred class of materials useful in the present invention are the water-insoluble sorbitan esters which comprise the reaction product of $C_{12}$–$C_{26}$ fatty acyl halides or fatty acids and the complex mixtures of cyclic anhydrides of sorbitol collectively known as "sorbitan". The reaction sequence necessary to produce such sorbitan esters from sorbitol is set out in the Baskerville patent incorporated by reference. The sorbitan esters are, in turn, complex mixtures of mono, di-, tri-, and tetra-ester forms, of which the tri- and tetra- are the least water-soluble and hence the most preferred for the purposes of the present invention. Typical fatty acids that are suitable for the alkyl portion of the ester are palmitic, stearic, docosanoic, and behenic acids and mixtures of any of these. These sorbitan esters, particularly the tri- and tetra-esters, provide a degree of fabric softening in addition to their function as dispersion inhibitors.

The previous discussion of organic dispersion inhibitors is an abbreviated one. Further discussion in detail is set out in the Baskerville et al patent.

Water-Soluble, Neutral or Alkaline Salt

As another preferred embodiment of the present invention, mixtures of anionic complexing components are used in forming the particulate detergent additives. These mixtures can be formed into a solution and sprayed onto the quaternary ammonium compound forming the desired complex, or, one of the complexing components, preferably a water-soluble neutral or alkaline salt, is added to the system as a solid prior to complexing with a solution of the remaining complexing component. The salt can assist in the formation of the complex, thus enhancing the benefits realized from its formation, and it can intself complex with the quaternary ammonium compound. Further, the salt can absorb excess moisture, making the particulate detergent additive stronger and more free-flowing. A neutral or alkaline salt has a pH in solution of seven or greater. This salt can be either organic or inorganic. The water-soluble, neutral or alkaline salt will be employed in the particulate detergent additive in an amount from about 5% to about 75% by weight, preferably from about 5% to about 40% by weight, and more preferably from about 10% to about 30% by weight of the particulate detergent additive.

In another embodiment, the dispersion inhibitor/-static control agent intimate mixture is admixed with the water-soluble neutral or alkaline salts described herein and this mixture is sprayed with water. The resulting product, which is free of conventional agglomerating agents (such as dextrin glues), is a very effective static control product, providing performance, cost and physical property benefits over similar agglomerates which utilize conventional agglomerating agents. This embodiment is described in detail in concurrently filed U.S. patent application Ser. No. 961,447, Draper, incorporated herein by reference.

Examples of such water-soluble neutral or alkaline salts include alkali metal chlorides such as sodium chloride and potassium chloride, alkali metal fluorides such as sodium fluoride and potassium fluoride, alkali metal carbonates such as sodium carbonates, alkali metal silicates, and mixtures thereof. Any conventional water-soluble, neutral or alkaline inorganic salts such as the alkali metal sulfates, notably sodium sulfate, can be employed in the present invention.

Water-soluble, neutral or alkaline salts also include the variety commonly known as detergency builder salts, especially alkaline, polyvalent anionic builder salts. Suitable detergency builder salts include polyvalent inorganic or organic salts or mixtures thereof. Suitable water-soluble, preferred inorganic alkaline detergency builder salts include alkali metal carbonates, borates, phosphates, polyphosphates, bicarbonates, silicates, and sulfates. Specific examples of such salts include the sodium and potassium tetraborates, perborates, bicarbonates, carbonates, tripolyphosphates, pyrophosphates, orthophosphates and hexametaphosphates.

Examples of suitable organic alkaline detergency builder salts are: water-soluble aminopolyacetates, e.g., sodium and potassium ethylenediaminetetraacetates, nitrilotriacetates and N-(2-hydroxyethyl)nitrilodiacetates; water-soluble salts of phytic acid, e.g., sodium and potassium phytates; water-soluble polyphosphates, including sodium, potassium and lithium salts of ethane-1-hydroxy-1,1-diphosphonic acid; sodium, potassium and lithium salts of methylene diphosphonic acid and comparable examples.

Additional organic builder salts are disclosed in U.S. Pat. No. 4,083,813, Wise, et al, issued Apr. 11, 1978, U.S. Pat. No. 3,308,067, Diehl, issued Mar. 7, 1967, and U.S. Pat. No. 2,264,103, Tucker, issued Nov. 25, 1941. The disclosures of the above patents are incorporated herein by reference. The Tucker patent particularly discloses polycarboxylate and citrate salts, notably sodium citrate which may be used in the present invention as a water-soluble, alkaline salt. Further detergency builder salts are disclosed in the Baskerville et al patent.

Optional Clay Ingredient

The particulate detergent additive may optionally contain smectite clay as an ingredient. These smectite clays may be admixed with the particulate detergent additive of this invention at levels from about 5% to about 70% by weight, preferably from about 20% to about 60% by weight, and most preferably from about 25% to about 50% by weight of the resulting admixture, to form compositions which provide laundered fabrics with outstanding fabric softening and static control benefits. The clays used herein are "impalpable", i.e., have a particle size which cannot be perceived tactilely. Impalpable clays have particle sizes below about 50 microns; the clays used herein have a particle size range of from 5 microns to about 50 microns.

The clay minerals can be described as expandable, three-layer clays, i.e., aluminosilicates and magnesium silicates, having an ion exchange capacity of at least 50 meq/100 g. of clay and preferably at least 60 meq/100 g. of clay. The term "expandable" as used to describe clays relates to the ability of the layered clay structure to be swollen, or expanded, on contact with water. The three-layer expandable clays used herein are those materials classified geologically as smectites.

There are two distinct classes of smectite clays that can be broadly differentiated on the basis of the numbers of octahedral metal-oxygen arrangements in the central layer for a given number of silicon-oxygen atoms in the outer layers.

The clays employed in the compositions of the instant invention contain cationic counterions such as protons, sodium ions, potassium ions, calcium ions, and lithium ions. It is customary to distinguish between clays on the basis of one cation predominantly or exclusively absorbed. For example, a sodium clay is one in which the absorbed cation is predominantly sodium. Such absorbed cations can become involved in exchange reactions with cations present in aqueous solutions. A typical exchange reaction involving a smectite-type clay is expressed by the following equation: smectite clay $(Na)^+ + NH_4OH \rightleftarrows$ smectite clay $(NH_4)^+ + NaOH$. Since, in the foregoing equilibrium reaction, one equivalent weight of ammonium ion replaces an equivalent weight of sodium, it is customary to measure cation exchange capacity (sometimes termed "base exchange capacity") in terms of milliequivalents per 100 g. of clay (meq/100 g.). The cation exchange capacity of clays can be measured in several ways, including by electrodialysis, by exchange with ammonium ion followed by titration or by a methylene blue procedure, all as fully set forth in Grimshaw, "The Chemistry and Physics of Clays", pp. 264–265, Interscience (1971), incorporated herein by reference.

The cation exchange capacity of a clay mineral relates to such factors as the expandable properties of the clay, the charge of the clay, which, in turn, is determined at least in part by the lattice structure, and the like. The ion exchange capacity of clays varies widely in the range from about 3 meq/100 g. of kaolinites to about 150 meq/100 g., and greater, for certain smectite clays. Illite clays, although having a three layer structure, are of a nonexpanding lattice type and have an ion exchange capacity somewhere in the lower portion of the range, i.e., around 26 meq/100 g. for an average illite clay. Attapulgites, another class of clay minerals, have a spicular (i.e. needle-like) crystalline form with a low cation exchange capacity (25–30 meq/100 g.). Their structure is composed of chains of silica tetrahedrons linked together by octahedral groups of oxygens and hydroxyl containing Al and Mg atoms.

It has been determined that illite, attapulgite, and kaolinite clays, with their relatively low ion exchange capacities, are not useful in the instant compositions. Indeed, illite and kaolinite clays constitute a major component of clay soils which are removed from fabric surfaces by means of the instant compositions. However, the alkali metal montmorillonites, saponites, and hectorites, and certain alkaline earth metal varieties of these minerals such as calcium montmorillonites have been found to show useful fabric-softening benefits when incorporated in compositions in accordance with the present invention. Specific examples of such fabric-softening smectite clay minerals are: sodium montmorillonite, sodium hectorite, sodium saponite, calcium montmorillonite, and lithium hectorite. Accordingly, smectite clays useful herein can be characterized as montmorillonite, hectorite, and saponite clay minerals having an ion exchange capacity of at least about 50 meq/100 g., and preferably at least 60 meq/100 g.

The above discussion of optional clay additives is intended to only be a brief cursory review of the subject matter contained in the Baskerville et al patent and in U.S. Pat. No. 4,062,647, issued to Storm et al on Dec. 13, 1977, incorporated herein by reference.

The smectite clays are preferably admixed with the particulate detergent additive after the additive has been aged for a time sufficient for the complexing reaction to have been substantially completed.

Surfactant

The particulate detergent additive of the present invention can be further incorporated in a detergent composition, by, for example, dry mix addition, with a surfactant selected from the group consisting of anionic, nonionic, zwitterionic and ampholytic surfactants, and mixtures thereof. From about 5% to about 85% by weight, preferably from about 5% to about 50% by weight, and most preferably from about 10% to about 25% by weight of the final detergent composition can comprise the organic surfactant component. Examples of organic surfactants useful herein have been described above as possible anionic complexing components, and are further described in U.S. Pat. No. 3,579,454, issued to E. J. Collier on May 18, 1971, incorporated herein by reference, from column 11, line 45 through column 13, line 64. An extensive discussion of surfactants is contained in the Baskerville et al patent, from column 11, line 39 through column 13, line 52, already incorporated hereinabove by reference.

Other Optional Ingredients

Other ingredients which are conventionally used in detergent compositions can be included in the detergent compositions of the present invention. These components include detergency builders, such as those enumerated in the Baskerville patent from column 13, line 54 through column 16, line 17, as well as color speckles, bleaching agents and bleach activators, suds boosters or suds suppressors, anti-tarnish and anti-corrosion agents, soil suspending agents, soil release agents, dyes, fillers, optical brighteners, germicides, pH adjusting agents, alkalinity sources, hydrotropes, enzymes, enzyme-stabilizing agents, perfumes, alkyl polyethoxylate nonionic surfactants, and other optional detergent compounds.

The detergent compositions of the instant invention can contain a detergency builder in an amount from about 5% to about 85% by weight, preferably from about 15% to about 60% by weight, and most preferably from about 20% to about 40% by weight of the entire detergent composition.

Method of Preparation

Initially, a solution containing from about 1% to about 80% by weight, preferably from about 5% to about 50% by weight of an anionic complexing component is prepared. Preferably, the anionic complexing component is present in solution at a concentration close to its saturation point. Overall, the anionic complexing component represents from about 1% to about 90% by weight, preferably from about 10% to about 60% by weight, of the particulate detergent additive. The anionic complexing component is selected from the group consisting of anionic synthetic surfactants; soaps, non-surfactant electrolytes selected from the group consisting of alkali metal phosphates, borates, carbonates, silicates, sulfates, and citrates; and mixtures thereof. In a preferred embodiment, water alone is the solvent of the complexing solution. The solution is sprayed onto the quaternary ammonium compound, resulting in the at least partial complexing of the quaternary ammonium compound with the anionic complexing component. The complex formed should constitute at least 25% of the surfaces of the antistatic particles. More preferably, the complex constitutes at least 50% of the surfaces, and most preferably the complex constitutes substantially all the surfaces of the antistatic particles. The reaction can also result in the complexation of substantially all of the quaternary ammonium compound, although it is preferred that the complexing be limited to the surfaces of the antistatic particles. The anionic complexing component can optionally be admixed as a solid with the quaternary ammonium compound prior to being complexed, preferably by being sprayed with a complexing medium. This complexing medium is preferably water or, with further improvement, a solution of anionic complexing component in water.

In a preferred embodiment of the present invention, the quaternary ammonium antistatic compound is intimately mixed with an organic dispersion inhibitor and formed into particulates, or prills, according to methods more fully described in the Baskerville et al patent. As another preferred embodiment, a water-soluble neutral or alkaline salt, preferably sodium tripolyphosphate, is admixed with the prills prior to the spray-on of either water alone or an anionic complexing solution. Water-soluble neutral or alkaline salts agglomerated with these prills are described in U.S. Pat. No,. 4,141,841, McDanald, issued Feb. 27, 1979, incorporated herein by reference. This procedure can also result in the formation of stable agglomerates consisting of the anionic complexing component and procedure can also result in the formation of stable agglomerates consisting of the anionic complexing component and the prilled particles. The agglomerates are substantially free of organic agglomerating agents and, preferably, water alone acts as the agglomerating agent. These agglomerates are fully described in concurrently filed U.S. patent application Ser. No. 961,447, Draper, incorporated herein by reference.

Smectite clay is optionally admixed or agglomerated into the additive product to provide an additional fabric-softening benefit.

The complexing medium can be sprayed onto the quaternary ammonium antistatic compound particles, prills, agglomerates, and other complexing components, in a mixer, such as the Schugi mixer (Flexomix 160, 250, 335 or 400), the O'Brien mixer, the Littleford mixer, the Patterson-Kelly mixer, ribbon mixers, a fluidized bed, and/or virtually any of the conventionally-known pan agglomerators. The optional smectite clays can be admixed with the additive product in a conventional pan agglomerator. The resulting particulate detergent additive composition is aged for approximately one hour, optionally mixed with silica if increased flowability is desired, and admixed with conventional detergent granules.

As used herein, all percentages, parts and ratios given are "by weight", unless otherwise specified.

The following nonlimiting examples illustrate the additives and compositions of the present invention. As discussed hereinafter in the examples, the words "comparable results" and substantially similar results are intended to indicate that static control benefits can also be obtained at reduced antistatic agent levels.

EXAMPLE I

A particulate detergent additive composition is prepared as follows:

| Ingredient | Wt. % |
|---|---|
| Dimethyl di-hydrogenated tallow ammonium chloride (95% active powder) | 75 |
| Tallow alcohol | 25 |
| | 100 |

The dimethyl di-hydrogenated tallow ammonium chloride (DTDMAC) and tallow alcohol were melted together to form a clear solution at 250° F. This molten solution was atomized at 1600 psi into a chamber with ambient temperature air passing through the chamber. The atomized droplets froze into solid particles in the size range of about 20 microns to about 150 microns. The softening point of the DTDMAC/tallow alcohol mixture was about 165° F. The DTDMAC/tallow alcohol mixture had a solubility of substantially less than 10 ppm in 25° C. water. The prills in all the subsequent examples have essentially the same characteristics.

Sodium tripolyphosphate (STP) and the DTDMAC/tallow alcohol prills, in a 7:4 ratio of prill:STP were fed into a Schugi mixer (Flexomix 160) where they were thoroughly admixed. The sodium tripolyphosphate was a dry, anhydrous, powder with at least 90% passing through a 100-mesh Tyler sieve. The 7:4 ratio prill:STP mixture was sprayed with an anionic complexing solution comprising 0.7 parts sodium citrate, per 1 part water.

The reaction of the anionic complexing components (the sodium citrate and the STP) with the DTDMAC in the prills resulted in the formation of a complex which constituted substantially all of the surfaces of the prills. This product was the particulate detergent additive of this Example.

The particulate detergent additive product was discharged from the Schugi Flexomix 160 mixer onto a pan agglomerator and there mixed with sodium montmorillonite clay of good fabric softening performance and having an ion exchange capacity of about 63 meq/100 g. (available from Georgia Kaolin Co. USA under the trade name Brock), which was also discharged onto the pan agglomerator. The resulting mix was aged for approximately one hour, mixed with silica to increase flowability, and then admixed, by dry mix addition, with a conventional detergent composition comprising surfactants, builders and other optional detergent ingredients.

The particulate detergent additive product provided increased static control performance and softening benefits relative to uncomplexed DTDMAC particles and to uncomplexed DTDMAC/tallow alcohol prills, either alone, when merely admixed with anionic complexing components or salts, or when agglomerated with anionic complexing components or salts, using conventional organic agglomerating agents.

Comparable results are obtained when the insoluble complex constitutes at least 25% of the surfaces of the DTDMAC particles or prills; and when the anionic complexing component complexes substantially all of the DTDMAC in the particles or prills.

Comparable results are obtained when the anionic complexing components, or mixtures thereof, are sprayed onto the DTDMAC particles or prills; when the complexing components are contacted in a fluidized bed reactor; and when the anionic complexing components, or mixtures thereof, are admixed as solids with the DTDMAC particles or prills and then sprayed with a complexing solution, which may comprise water and optionally other anionic complexing components.

Substantially similar results are obtained when the sodium citrate and/or the STP are replaced with other anionic complexing components, such as: sodium tetraborate, potassium tetraborate, potassium tripolyphosphate, sodium pyrophosphate, potassium pyrophosphate, sodium hexametaphosphate, potassium hexametaphosphate, sodium sulfate, potassium sulfate, potassium citrate, anionic surfactants such as $C_{10}$–$C_{14}$ linear and branched alkylbenzene sulfonates and $C_{10}$–$C_{18}$ alkyl sulfates, and mixtures thereof.

Substantially similar results are obtained when sodium tripolyphosphate is replaced with other water-soluble neutral or alkaline salts, such as: sodium tetraborate, potassium tetraborate, potassium tripolyphosphate, sodium pyrophosphate, potassium pyrophosphate, sodium hexametaphosphate, potassium hexametaphosphate, sodium sulfate, potassium sulfate, sodium citrate, potassium citrate, and mixtures thereof.

Comparable results are obtained when the quaternary ammonium compound utilized is ditallow dimethyl ammonium methylsulfate, ditallow dimethyl ammonium ethylsulfate, 1-methyl-1-[(tallowamido)ethyl]-2-tallowimidazolinium methylsulfate, or mixtures thereof in place of the ditallow dimethyl ammonium chloride on a part for part basis.

Substantially similar results are obtained when the organic dispersion inhibitor is a mixture of $C_{10}$–$C_{22}$ alkyl sorbitan esters, the major components of which is one or more esters selected from the group consisting of sorbitan trilaurate, sorbitan trimyristate, sorbitan tripalmitate, sorbitan tristearate, sorbitan tetralaurate, sorbitan tetramyristate, sorbitan tetrapalmitate, sorbitan tetrastearate, and mixtures thereof.

Comparable results are obtained when the organic dispersion inhibitor and/or the water-soluble neutral or alkaline salt are deleted from the system.

Comparable results are obtained when the clay is deleted from the system, or when other types of clay are substituted for sodium montmorillonite, such as sodium hectorite, sodium saponite, calcium montmorillonite, lithium hectorite, and mixtures thereof.

The silica is an optional additive, and substantially similar results are achieved without its inclusion.

Other types of mixers which are used in place of the Schugi Flexomix 160 are the Schugi Flexomix 250, 335, and 400, the O'Brien mixer, the Littleford mixer, the Patterson-Kelly mixer, ribbon mixers, and/or virtually any of the conventionally known pan agglomerators.

EXAMPLE II

The particulate detergent additive of Example I was incorporated into a detergent composition as follows:

| | Parts |
|---|---|
| Base Detergent Granule | |
| Sodium ($C_{12}$) linear alkylbenzene sulfonate | 12.0 |
| Sodium ($C_{14-15}$) alkyl polyehtoxylate (1.1) sulfate | 6.0 |
| Sodium silicate (2.0 ratio) | 11.5 |
| Tallow fatty acid | 0.5 |
| Sodium tripolyphosphate | 16.8 |
| Sodium sulfate | 16.5 |
| Moisture | 5.3 |
| TOTAL base detergent granule | 68.6 |

-continued

| | Parts |
|---|---|
| Admix | |
| Sodium montmorillonite clay (ion exchange capacity about 63 meq/100 g, commercially available from Georgia Kaolin Co., USA, under the trade name BROCK) | 10.4 |
| Sodium tripolyphosphate | 7.6 |
| Particulate detergent additive (complexed DTDMAC/tallow alcohol prills of Example I) | 6.9 |
| Miscellaneous (perfume, speckles, water and others) | 6.5 |
| TOTAL | 100.0 |

EXAMPLE III

The particulate detergent additive of Example I is incorporated into a detergent composition as follows:

| | Parts |
|---|---|
| Base Detergent Granule | |
| Sodium ($C_{12}$) linear alkyl benzene sulfonate | 12.0 |
| Sodium ($C_{14-15}$) alkyl polyethoxylate (1.1) sulfate | 6.0 |
| Sodium silicate (1.6 ratio) | 7.0 |
| Sodium aluminosilicate (hydrated Zeolite A, particle diameter 1–10$\mu$) | 20.0 |
| Sodium sulfate | 26.1 |
| Sodium citrate | 5.0 |
| Moisture | 4.8 |
| TOTAL base detergent granule | 80.9 |
| Admix | |
| Sodium montmorillonite clay (ion exchange capacity about 63 meq/100 g, commercially available from Georgia Kaolin Co., USA, under the trade name BROCK) | 9.0 |
| Particulate detergent additive (complexed DTDMAC/tallow alcohol prills of Example I) | 8.0 |
| Miscellaneous (perfume, speckles, water and others) | 2.1 |
| TOTAL | 100.00 |

The compositions of Examples II and III provide the static control advantages at reduced antistatic agent levels, as described in Example I.

EXAMPLE IV

A particulate detergent additive composition was prepared as follows:

The 7:4 ratio prills:STP mixture of Example I were fed into a Schugi mixer and sprayed with water. The water acted as an agglomerating agent and stable STP/prill agglomerates, the particulate detergent additive of this Example, were formed. The agglomerates were then discharged from the Schugi mixer onto a pan agglomerator and there admixed with sodium montmorillonite clay. The resulting mix was aged for approximately one hour, mixed with silica to increase flowability, and then admixed, by dry mix addition, with a conventional detergent composition comprising surfactants, builders and other optional ingredients.

The particulate detergent additive provided stable agglomerates and increased static control performance and softening benefits relative to STP/prill agglomerates formed using conventional agglomerating agents, such as dextrin glues. Also, material costs were reduced and extra processing and handling steps were eliminated due to the elimination of conventional agglomerating agents.

Substantially similar results are obtained when the STP/prill mixture is agglomerated with solutions comprising water and being substantially free of organic agglomerating agents.

Substantially similar results are obtained when sodium tripolyphosphate is replaced with other water-soluble neutral or alkaline salts, such as: sodium tetraborate, potassium tetraborate, sodium bicarbonate, potassium bicarbonate, sodium carbonate, potassium carbonate, potassium tripolyphosphate, sodium pyrophosphate, potassium pyrophosphate, sodium hexametaphosphate, potassium hexametaphosphate, sodium sulfate, potassium sulfate, sodium citrate, potassium citrate, and mixtures thereof.

Comparable results are obtained when the quaternary ammonium compound utilized is ditallow dimethyl ammonium methylsulfate, ditallow dimethyl ammonium ethylsulfate, 1-methyl-1-[(tallowamido)ethyl]-2-tallowimidazolinium methylsulfate, or mixtures thereof in place of the ditallow dimethyl ammonium chloride on a part for part basis.

Substantially similar results are obtained when the organic dispersion inhibitor is a mixture of $C_{10}$–$C_{22}$ alkyl sorbitan esters, the major components of which is one or more esters selected from the group consisting of sorbitan trilaurate, sorbitan trimyristate, sorbitan tripalmitate, sorbitan tristearate, sorbitan tetralaurate, sorbitan tetramyristate, sorbitan tetrapalmitate, sorbitan tetrastearate, and mixtures thereof.

Comparable results are obtained when the clay is deleted from the system, or when other types of clay are substituted for sodium montmorillonite, such as sodium hectorite, sodium saponite, calcium montmorillonite, lithium hectorite, and mixtures thereof.

The silica is an optional additive, and substantially similar results are achieved without its inclusion.

Other types of mixers which are used in place of the Schugi Flexomix 160 are the Schugi Flexomix 250, 335, and 400, the O'Brien mixer, the Littleford mixer, the Patterson-Kelly mixer, ribbon mixers, and/or virtually any of the conventionally known pan agglomerators.

EXAMPLE V

A particulate detergent additive composition was prepared as follows:

A 7:8 part ratio prills (DTDMAC/tallow alcohol):STP mixture was agglomerated according to the procedure of Example IV, and admixed with sodium montmorillonite clay.

The composition of the admix was as follows:

| Admix | Parts |
|---|---|
| DTDMAC | 14.5 |
| STP | 33.4 |
| Water | 13.9 |
| Miscellaneous | 8.2 |
| Sodium montmorillonite clay | 30.0 |
| TOTAL | 100.0 |

The above-described mix was admixed on a 31 part basis, by dry mix addition, with the base detergent granule composition described in Example II. The detergent composition demonstrated the benefits described in Example IV.

EXAMPLE VI

A 7:4 ratio prill:STP mixture was prepared according to the procedure of Example I. The mixture was sprayed with an anionic complexing solution in a Schugi mixer. This procedure was repeated with other anionic complexing solutions being sprayed onto other samples of 7:4 prill:STP mixtures. As a control composition, a 7:4 prill:STP mixture was sprayed with a dextrin-water organic agglomerating agent solution. The reaction of the anionic complexing components (the STP and the anionic component contained in the solution) with the DTDMAC in the prills resulted in the formation of a relatively insoluble complex which constituted at least 10% of the surfaces of the prills. Sodium montmorillonite clay was admixed with the complexed prills and/or the complexed prill agglomerates in a pan agglomerator. The resulting admix was incorporated into a conventional detergent composition, by dry mix addition, with the base detergent granules of Example II.

A series of fabrics were washed in these respective compositions, including the control composition, at a wash water temperature of about 100° F. and at a water hardness of about 2 grains per gallon, and then dried under ordinary machine drying conditions and at a dew point of about 40.5° F. These were full-scale washer and dryer loads using conventional fabric bundles. The fabrics were then measured for average volts per square yard using a Faraday cage apparatus and for number of clings.

The results of these tests, under ordinary wash water and machine drying conditions, demonstrated that the complexed prills and/or the complexed prill agglomerates formed by spraying certain anionic complexing solutions onto the prill/STP mixture delivered superior static control benefits to the fabrics at reduced antistatic agent levels relative to the control composition formed by spraying a dextrin-in-water solution onto the prill/STP mixture.

The admix compositions and the percent usage of the admix (equivalent to 5.0% DTDMAC in the finished product) in the final detergent compositions were as follows:

| Sample | Composition | Parts |
|---|---|---|
| 63A | (23.85% usage) Prill:STP mixture | |
| | DTDMAC | 20.96 |
| | Tallow alcohol | 7.76 |
| | STP | 16.43 |
| | Complexing solution | |
| | Sodium sulfate | 0.97 |
| | Water | 8.69 |
| | Clay | 45.17 |
| Sample | Composition | Parts |
| 72A | (22.90% usage) Prill:STP Mixture | |
| | DTDMAC | 21.83 |
| | Tallow alcohol | 8.11 |
| | STP | 17.11 |
| | Complexing solution | |
| | Sodium sulfate | 2.10 |
| | $C_{12}$ linear alkyl benzene sulfonate | 1.40 |
| | Water | 3.50 |
| | Clay | 45.95 |
| Sample | Composition | Parts |
| 73B | (26.39% usage) Prill:STP Mixture | |
| | DTDMAC | 18.95 |

-continued

| Sample | Composition | Parts |
|---|---|---|
| | Tallow alcohol | 7.04 |
| | STP | 14.85 |
| | Complexing solution | |
| | Sodium sulfate | 3.00 |
| | $C_{12}$ tallow alkyl sulfate | 4.73 |
| | Water | 9.89 |
| | Clay | 40.84 |
| Sample | Composition | Parts |
| | (25.68% usage) | |
| 75A | Prill:STP Mixture | |
| | DTDMAC | 19.47 |
| | Tallow alcohol | 7.23 |
| | STP | 15.26 |
| | Complexing solution | |
| | STP (not all in soln.) | 5.59 |
| | Water | 11.19 |
| | Clay | 41.26 |
| Sample | Composition | Parts |
| | (25.33% usage) | |
| 75C | Prill:STP Mixture | |
| | DTDMAC | 19.74 |
| | Tallow alcohol | 7.34 |
| | STP | 15.47 |
| | Complexing solution | |
| | Sodium sulfate (not all in solution) | 5.20 |
| | Water | 10.40 |
| | Clay | 41.84 |
| Sample | Composition | Parts |
| | (26.00% usage) | |
| Control | Prill:STP Mixture | |
| | DTDMAC | 19.4 |
| | Tallow alcohol | 6.6 |
| | STP | 15.1 |
| | Agglomerating solution | |
| | Dextrin glue | 5.5 |
| | Water | 10.3 |
| | Clay | 42.9 |
| | Miscellaneous | 0.2 |
| | | 100.0 |

The results were as follows:

| Static Control Test Data | | | | | |
|---|---|---|---|---|---|
| Sample | % DTDMAC | Ave. $\epsilon$[v]/yd$^2$ | Std. Dev. | Ave. Clings | Std. Dev. |
| Control | 4.92 (4 runs) | 2.3 | 0.3 | 2.5 | 1.0 |
| | 3.5 (2 runs) | 6.6 | 0.6 | 7.0 | 0.0 |
| 63A | 3.5 (2 runs) | 2.7 | 1.1 | 2.0 | 0.0 |
| | 2.5 (2 runs) | 1.3 | 0.4 | 0.0 | 0.0 |
| | 1.5 | 5.6 | | 5.0 | |
| 72A | 3.5 (3 runs) | 2.2 | 1.6 | 1.0 | 1.7 |
| | 2.5 (3 runs) | 2.5 | 1.6 | 2.0 | 2.0 |
| | 1.5 (5 runs) | 4.3 | 2.3 | 3.2 | 2.3 |
| 73B | 3.5 | 2.1 | | 2.0 | |
| | 2.5 | 2.2 | | 4.0 | |
| 75A | 3.5 | 2.8 | | 4.0 | |
| | 2.5 (2 runs) | 2.8 | 2.0 | 2.0 | 2.8 |
| 75C | 3.5 | 3.9 | | 3.0 | |
| | 2.5 (3 runs) | 2.0 | 0.6 | 1.0 | 1.7 |
| | 1.5 (5 runs) | 6.6 | 1.4 | 7.2 | 1.8 |

What is claimed is:

1. The particulate detergent additive for preventing static buildup on textiles and softening fabrics when applied thereto from a laundry solution, said particulate additive being produced by the at least partial complexing of:

(a) from about 1% to about 90% by weight of an anionic complexing component selected from the group consisting of anionic synthetic surfactants; soaps; nonsurfactant electrolytes selected from the group consisting of alkali metal phosphates, borates, carbonates, silicates, sulfates, and citrates; and mixtures thereof; and (b) from about 10% to about 99% by weight of particles of an intimate mixture of:

(i) from about 90% to about 20% by weight of a quaternary ammonium compound of formula $[R_1R_2R_3R_4N]^+Y^-$ wherein at least one, but not more than two, of $R_1$, $R_2$, $R_3$, and $R_4$ is an organic radical containing a group selected from a $C_{16}$–$C_{22}$ aliphatic radical, or an alkyl phenyl or alkyl benzyl radical having 10 to 16 carbon atoms in the alkyl chain, the remaining group or groups being selected from $C_1$–$C_4$ alkyl, $C_2$–$C_4$ hydroxy alkyl, and cyclic structures in which the nitrogen atom forms part of the ring, Y constituting an anionic radical selected from the group consisting of hydroxide, halide, sulfate, methylsulfate, ethylsulfate and phosphate ions, and (ii) from about 10% to about 80% by weight of a dispersion inhibitor, being a solid organic material having a solubility in water of 50 ppm maximum at 25° C. and a softening point in the range of 75° F. to 250° F., said material being selected from the group consisting of paraffinic waxes, cyclic and acyclic mono- and polyhydric alcohols, substituted and unsubstituted aliphatic carboxylic acids, esters of the foregoing alcohols and acids, $C_3$–$C_4$ alkylene oxide condensates of any of the foregoing materials and mixtures thereof, wherein said complex constitutes at least 25% of the surfaces of said particulate additive and wherein substantially all of the additive particles have a size of about 10 microns to about 500 microns, a solubility in water of about 50 ppm maximum at 25° C., and a softening point of from about 75° F. to about 250° F.

2. The particulate detergent additive of claim 1 wherein said complex constitutes at least 50% of the surfaces of the particulate additive.

3. The particulate detergent additive of claim 2 wherein said complex constitutes substantially all the surfaces of the particulate additive.

4. The particulate detergent additive of claim 2 wherein the anionic complexing component complexes substantially all of the quaternary ammonium compound.

5. The particulate detergent additive of claim 1 wherein substantially all the additive particles are from about 25 microns to about 250 microns in size and have a softening point of about 150° F. to about 175° F.

6. The particulate detergent additive of claim 1 comprising from about 5% to about 60% by weight of said anionic complexing component.

7. The particulate detergent additive of claim 1 wherein the anionic complexing component is selected from the group consisting of sodium tetraborate, potassium tetraborate, sodium tripolyphosphate, potassium tripolyphosphate, sodium pyrophosphate, potassium pyrophosphate, sodium hexametaphosphate, potassium hexametaphosphate, sodium sulfate, potassium sulfate, sodium citrate, potassium citrate, sodium and potassium $C_{10}$–$C_{14}$ linear and branched alkylbenzene sulfonates, sodium and potassium $C_{10}$–$C_{18}$ alkyl sulfates, and mixtures thereof.

8. The particulate detergent additive of claim 7 wherein the anionic complexing component is selected from the group consisting of sodium tripolyphosphate, sodium sulfate, sodium $C_{10}$–$C_{14}$ linear and branched alkylbenzene sulfonates, and mixtures thereof.

9. The particulate detergent additive of claim 1 comprising from about 20% to about 75% by weight of the intimate mixture (b).

10. The particulate detergent additive of claim 9 wherein the quaternary ammonium compound represents from about 80% to about 50% by weight of the intimate mixture particles.

11. The particulate detergent additive of claim 1 wherein the quaternary ammonium compound is selected from the group consisting of ditallow dimethyl ammonium chloride, ditallow dimethyl ammonium methylsulfate, ditallow dimethyl ammonium ethylsulfate, 1-methyl-1-[(tallowamido)ethyl]-2-tallowimidazolinium methylsulfate, and mixtures thereof.

12. The particulate detergent additive of claim 11 wherein the quaternary ammonium compound is ditallow dimethyl ammonium chloride.

13. The particulate detergent additive of claim 11 wherein the dispersion inhibitor is selected from the group consisting of $C_{14}$–$C_{26}$ fatty alcohols, $C_{12}$–$C_{24}$ fatty acids and $C_{10}$–$C_{22}$ alkyl sorbitan esters.

14. The particulate detergent additive of claim 13 wherein the dispersion inhibitor is tallow alcohol.

15. The particulate detergent additive of claim 13 wherein the anionic complexing component is selected from the group consisting of sodium tetraborate, potassium tetraborate, sodium tripolyphosphate, potassium tripolyphosphate, sodium pyrophosphate, potassium pyrophosphate, sodium hexametaphosphate, potassium hexametaphosphate, sodium sulfate, potassium sulfate, sodium citrate, potassium citrate, sodium and potassium $C_{10}$–$C_{14}$ linear and branched alkylbenzene sulfonates, sodium and potassium $C_{10}$–$C_{18}$ alkyl sulfates, and mixtures thereof.

16. The particulate detergent additive of claim 15 wherein the anionic complexing component is selected from the group consisting of sodium tripolyphosphate, sodium sulfate, sodium $C_{10}$–$C_{14}$ linear and branched alkylbenzene sulfonates, and mixtures thereof.

17. The particulate detergent additive of claim 15 wherein the quaternary ammonium compound is ditallow dimethyl ammonium chloride and the dispersion inhibitor is tallow alcohol.

18. The particulate detergent additive of claim 17 wherein the complex constitutes substantially all of the surfaces of the particulate additive.

19. The particulate detergent additive of claim 1 wherein the anionic complexing component is in an aqueous solution comprising from about 1% to about 80% by weight of said complexing component.

20. The particulate detergent additive of claim 1 wherein an admix of an anionic complexing component and the intimate mixture particles is sprayed with an aqueous complexing solution containing an anionic complexing component.

21. The particulate detergent additive of claim 20 wherein the anionic complexing component admixed with the intimate mixture particles is sodium tripolyphosphate.

22. A fabric softening/static control composition comprising the particulate detergent additive of claim 1 admixed with about 5% to about 70% by weight of smectite clay having an ion exchange capacity of at least 50 meq/100 g.

23. The composition of claim 22 comprising from about 25% to about 50% by weight of smectite clay having an ion exchange capacity of at least 60 meq/100 g.

24. A detergent composition for preventing static buildup on textiles and softening fabrics laundered therewith, comprising:

(1) from about 5% to about 85% by weight of surfactant selected from the group consisting of anionic, nonionic, ampholytic, and zwitterionic surfactants, and mixtures thereof, (2) from about 5% to about 85% by weight of detergency builder material, (3) from about 3% to about 50% by weight of a particulate detergent additive produced by the at least partial complexing of:

(a) from about 1% to about 90% by weight of an anionic complexing component selected from the group consisting of anionic synthetic surfactants; soaps; nonsurfactant electrolytes selected from the group consisting of alkali metal phosphates, borates, carbonates, silicates, sulfates, and citrates; and mixtures thereof; and (b) from about 10% to about 99% by weight of particles of an intimate mixture of:

(i) from about 90% to about 20% by weight of a quaternary ammonium compound of formula $[R_1R_2R_3R_4N]^+Y^-$ wherein at least one, but not more than two, of $R_1$, $R_2$, $R_3$, and $R_4$ is an organic radical containing a group selected from a $C_{16}$–$C_{22}$ aliphatic radical, or an alkyl phenyl or alkyl benzyl radical having 10 to 16 carbon atoms in the alkyl chain, the remaining group or groups being selected from $C_1$–$C_4$ alkyl, $C_2$–$C_4$ hydroxy alkyl, and cyclic structures in which the nitrogen atom forms part of the ring, Y constituting an anionic radical selected from the group consisting of hydroxide, halide, sulfate, methylsulfate, ethylsulfate and phosphate ions, and (ii) from about 10% to about 80% by weight of a dispersion inhibitor, being a solid organic material having a solubility in water of 50 ppm maximum at 25° C. and a softening point in the range of 75° F. to 250° F., said material being selected from the group consisting of paraffinic waxes, cyclic and acyclic mono- and polyhydric alcohols, substituted and unsubstituted aliphatic carboxylic acids, esters of the foregoing alcohols and acids, $C_3$–$C_4$ alkylene oxide condensates of any of the foregoing materials and mixtures thereof, wherein said complex constitutes at least 25% of the surfaces of said particulate additive and wherein substantially all of the additive particles have a size of about 10 microns to about 500 microns, a solubility in water of about 50 ppm maximum at 25° C., and a softening point of from about 75° F. to about 250° F.

25. The composition of claim 24 wherein the anionic complexing component is selected from the group consisting of sodium tetraborate, potassium tetraborate, sodium tripolyphosphate, potassium tripolyphosphate, sodium pyrophosphate, potassium pyrophosphate, sodium hexametaphosphate, potassium hexametaphosphate, sodium sulfate, potassium sulfate, sodium citrate, potassium citrate, sodium and potassium $C_{10}$–$C_{14}$ linear and branched alkylbenzene sulfonates, sodium and potassium $C_{10}$–$C_{18}$ alkyl sulfates, and mixtures thereof.

26. The composition of claim 25 wherein the quaternary ammonium compound is selected from the group consisting of ditallow dimethyl ammonium chloride, ditallow dimethyl ammonium methylsulfate, ditallow dimethyl ammonium ethylsulfate, 1-methyl-1-[(tallowamido)ethyl]-2-tallow-imidazolinium methylsulfate, and mixtures thereof.

27. The composition of claim 26 wherein the dispersion inhibitor is selected from the group consisting of $C_{14}$–$C_{26}$ fatty alcohols, $C_{12}$–$C_{24}$ fatty acids and $C_{10}$–$C_{22}$ alkyl sorbitan esters.

28. The composition of claim 27 wherein the anionic complexing component is selected from the group consisting of sodium tripolyphosphate, sodium sulfate, sodium $C_{10}$–$C_{14}$ linear and branched alkylbenzene sulfonates, and mixtures thereof.

29. The composition of claim 28 wherein the quaternary ammonium compound is ditallow dimethyl ammonium chloride and the dispersion inhibitor is tallow alcohol.

30. The composition of claims 27 or 29 wherein the complex constitutes substantially all of the surfaces of the particulate additive (3).

* * * * *